United States Patent [19]

Miyagawa et al.

[11] Patent Number: 5,034,301

[45] Date of Patent: Jul. 23, 1991

[54] RECORDING MEDIUM

[75] Inventors: Masashi Miyagawa, Kawasaki; Masanori Takenouchi, Atsugi; Norio Ohkuma, Machida, all of Japan

[73] Assignee: Canon Kabushiki Kaisha, Tokyo, Japan

[21] Appl. No.: 383,252

[22] Filed: Jul. 21, 1989

Related U.S. Application Data

[63] Continuation of Ser. No. 127,930, Dec. 2, 1987, abandoned.

[30] Foreign Application Priority Data

Dec. 2, 1986 [JP] Japan ..... 61-287077

[51] Int. Cl.[5] ..... G03C 1/72

[52] U.S. Cl. ..... 430/138; 428/195; 428/212; 428/321.5; 428/913; 428/914; 430/211; 503/208; 503/214; 503/215

[58] Field of Search ..... 428/195, 212, 484, 488.1, 428/913, 914; 430/138, 211

[56] References Cited

U.S. PATENT DOCUMENTS

| | | | |
|---|---|---|---|
| 3,671,240 | 6/1972 | Gramza et al. | 96/29 R |
| 3,798,034 | 3/1974 | Laridon | 96/15 |
| 4,399,209 | 8/1983 | Sanders et al. | 430/211 |
| 4,416,966 | 11/1983 | Sanders et al. | 430/138 |

FOREIGN PATENT DOCUMENTS

| | | |
|---|---|---|
| 261394 | of 1876 | European Pat. Off. . |
| 260124 | of 1987 | European Pat. Off. . |
| 2128831 | 1/1972 | Fed. Rep. of Germany . |
| 2205191 | 9/1972 | Fed. Rep. of Germany . |
| 3715991 | 11/1987 | Fed. Rep. of Germany . |

OTHER PUBLICATIONS

Patent Abstracts of Japan, vol. 11, No. 255 (M-617) (2702, 8/19/87).

Patent Abstracts of Japan, vol. 8, No. 61 (P-284) (1498), 11/23/84.

*Primary Examiner*—Bruce H. Hess

*Attorney, Agent, or Firm*—Fitzpatrick, Cella, Harper & Scinto

[57] ABSTRACT

A transfer recording medium comprises a support and a recording layer formed thereon comprising at least a colorant and a functional component sensitive to provision of light energy and heat energy. The recording layer is composed to have a specifically high sensitivity selective to provision of both light energy and heat energy defined as follows. The adhesion force $f_1$ between the support and the recording layer and the adhesion force $f_2$ between the recording layer and a transfer-receiving medium such as plain paper satisfy the relations of $f_1 > f_2$ at a lower temperature and $f_1 < f_2$ at a higher heated temperature. A minimum exposure quantity is defined as a minimum quantity of light, with a wavelength to which the functional component in the recording layer is sensitive at 100° C., providing $f_1 > f_2$ at the higher heated temperature when the recording layer is exposed to the light and then heated. Then, the recording layer provides $f_1 < f_2$ at the higher heated temperature when it is exposed at 30° C. to the light with an exposure quantity, which is 5 times the minimum quantity, and then heated.

6 Claims, 5 Drawing Sheets

RECORDING MEDIUM

This application is a continuation of application Ser. No. 127,930 filed Dec. 2, 1987 now abandoned.

FIELD OF THE INVENTION AND RELATED ART

The present invention relates to a novel recording medium for use in a recording apparatus such as a printer, a copying machine and a facsimile recorder, particularly a recording medium for use in a recording system adapted to one-shot color recording.

In recent years, various recording methods and apparatus adapted for various information processing systems have been developed and adapted. Among these, the thermal transfer recording method has advantages in that the apparatus employed is light weight, compact, free of noise, excellent in operability and adapted to easy maintenance. Accordingly this method has been recently widely used. According to this method, plain paper can be used as a transfer-receiving medium.

However, the heat-sensitive transfer recording method of the prior art is not free from drawbacks. That is, according to the thermal transfer recording method of the prior art, the transfer recording performance, namely the printed letter quality, is strongly influenced by the surface smoothness of the transfer-receiving medium, and therefore while good printing can be effected on a transfer-receiving medium having high smoothness, the printed letter quality will be markedly lower in the case of a transfer-receiving medium with low smoothness. Although paper, which is the most typical transfer-receiving medium, may be used problems are present. A paper with high smoothness is rather special while ordinary papers have surface unevenness to various degrees because they are formed through entanglement of fibers. As a result, according to the conventional thermal transfer recording method, the resulting printed image on paper may not have a sharp edge or a part of the image may be missing thus lowering the printed letter quality.

Further, in the conventional thermal transfer recording method, while the transfer of an ink layer to the transfer-receiving medium is caused by only the heat supplied from a thermal head, it is difficult even from a theoretical point of view to increase, the heat supply from the thermal head. This is a problem because it is required to cool the thermal head to a prescribed temperature in a limited short time and it is also necessary to prevent occurrence of thermal crosstalk between heat-generation segments or elements constituting the thermal head face. For this reason, high speed recording has been difficult to realize according to the conventional thermal transfer recording method.

Further, as heat conduction has a slow response speed compared with electricity or light, it has been generally difficult to control a heat pulse sufficient to reproduce a medium tone by the conventional recording system using a transfer medium, and also it has been impossible to effect a medium tone recording as the conventional thermal transfer ink layer lacks a transfer function for gradational representation.

Further, in the conventional thermal transfer recording method, it has been only possible to obtain one image color through one transfer operation, and accordingly, it has been necessary to repeat the transfer step several times to superpose colors in order to obtain a multi-color image. Since is very difficult to exactly superpose images of different colors it has been difficult to obtain an image free of color deviation or aberration. Particularly, when one picture element is involved, superposition of colors has not been effected in such a one-picture element, and consequently, a multi-color image has been constituted by assembly or gathering of picture elements involving color deviation in the conventional thermal transfer recording method. For this reason, it has been impossible to obtain a clear multicolor image according to the conventional thermal transfer recording method.

Further, when it is desired to obtain a multicolor image by the conventional thermal, transfer recording method, there have been attendant difficulties such as provision of plural thermal heads or complex movements involving reversals of direction and stopping of a transfer-receiving medium which requires a large and complex apparatus or a decrease in recording speed.

There has been proposed a transfer imaging method for producing a multicolor image by using a color precursor (chromogenic material) and a developer (U.S. Pat. No. 4,399,209). More specifically, in this method, an imaging sheet comprising a substrate and a coating thereon comprising a chromogenic material and a radiation curable composition encapsulated in rupturable capsules, is provided; the coating is subjected to imagewise exposure with actinic radiation to cure the radiation curable composition and form a latent image and the latent image is superposed onto a developer sheet to form a visible image on the developer sheet.

Further, U.S. Pat. No. 4,416,966 discloses a self-contained image-formation system wherein an imaging sheet comprising a developer and photosensitive microcapsules on the same surface of a support is used. The imaging sheet is exposed to mainly ultraviolet radiation modulated according to recording images, and then passed between pressure rollers where the micro-capsules are ruptured to liberate the enclosed material imagewise. Concurrently, the color former is migrated to contact the developer which is usually contained in a separate layer to cause a reaction to form a color image.

In both of the above two recording systems, only light energy is used for forming a latent image on a transfer recording medium (image sheet), so that a recording medium highly sensitive to light or a light flux of a high energy is required in order to obtain a clear image at a high speed. A high sensitivity recording medium generally has a poor storage stability and is therefore not appropriate for easy handling. Further, it is difficult to obtain a high energy required for curing a radiation-curable composition at a high speed with a single, kind of energy, particularly light energy, thus a large apparatus has been generally required.

Further, in the above recording system a colorforming reaction of a leuco dye is utilized so that the resultant recorded image is essentially inferior in stability.

Further, in order to facilitate the development through pressure of application, it is required that material the enclosed in the micro-capsules as such a photosensitive composition is liquid at room temperature and has a poor storability. Moreover, the resultant image is accompanied with an odor of a monomer because nonreacted material is ruptured, providing an undesirable characteristic.

In order to solve the above mentioned problems, an image forming method has been proposed (U.S. patent application Ser. No. 869,689 corr. to Japanese Patent Application No. 128814/1986).

These applications basically disclose an image forming method, comprising: providing a transfer recording medium comprising a transfer recording layer, the transfer recording layer being capable of causing an irreversible change in transfer characteristic thereof when provided with plural kinds of energies; imparting the plural kinds of energies to the transfer recording layer under such a condition that at least one of the plural kinds of energies corresponds to a recording information signal, thereby to form a transferable portion in the transfer recording layer; and transferring the transferable portion of the transfer recording layer to a transfer-receiving medium, thereby to leave an image corresponding to the transferable portion on the transfer,-receiving medium.

It has been further proposed a recording method having improved the above imageforming method in respect of the fixability of the recorded image (U.S. patent application Ser. No. 927,876) and a recording method wherein a vaporizable dye is used in the above image-forming method (U.S. patent application Ser. No. 70,194).

SUMMARY OF THE INVENTION

A principal object of the present invention is to provide a recording medium, which is suitable for use in the above-mentioned image-forming methods. The invention has solved the problems of the conventional methods as mentioned above, i.e., the methods which can provide transferred images of a high quality, are capable of effecting high-speed recording and medium tone recording and can provide clear multi color images free of color deviation without accompanying complicated movement of a transfer-receiving medium.

A more specific object of the present invention is to provide a recording medium which is suitable for used in the above-mentioned image-forming methods, having high environmental stability and has remarkably decreased white-dropping of images.

According to the present invention, there is provided a transfer recording medium comprising a support, and a recording layer formed thereon comprising at least a colorant and a functional component sensitive to provision of light energy and heat energy, wherein the adhesion force $f_1$ between the support and the recording layer and the adhesion force $f_2$ between the recording layer and a transfer-receiving medium satisfy the relations of $f_1 > f_2$ at a lower temperature and $f_1 < f_2$ at a higher heated temperature; and if a minimum exposure quantity is defined as a minimum quantity of light, with a wavelength to which the functional component in the recording layer is sensitive at 100° C., providing $f_1 > f_2$ at the higher heated temperature when the recording layer is exposed to the light and then heated, the recording layer provides $f_1 < f_2$ at the higher heated temperature when it is exposed at 30° C. to the light with an exposure quantity which is 5 times the minimum exposure quantity and then heated.

These and other objects, features and advantages of the present invention will become more apparent upon a consideration of the following description of the preferred embodiments of the present invention taken in conjunction with the accompanying drawings, wherein like parts are denoted by like reference numerals. "Parts" or "%" used hereinafter with reference to a composition are by weight unless otherwise noted specifically.

DETAILED DESCRIPTION OF THE INVENTION

Figure 1:
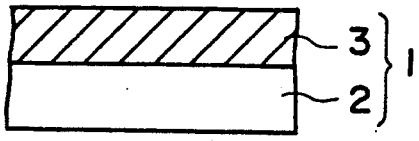
FIG. 1 is a sectional view of a basic embodiment of the transfer recording medium according to the present invention.

Referring to FIG. 1, a transfer recording medium 1 comprises a support 2 and a recording layer 3 on the support. The recording layer 3 comprises at least a colorant and a functional component sensitive to a light energy and a heat energy. The functional component comprises at least a photopolymerization initiator and a monomer, oligomer or prepolymer having an ethylenically unsaturated double bond.

In order to effect recording, at least one of light and heat energies is supplied to the transfer recording layer corresponding to given recording information to provide portions having different transfer characteristics, so that a transferable image based on a difference in transfer characteristic is formed and transferred to a transfer-receiving medium.

The physical property controlling the transfer characteristic may be determined depending on a particular type of transfer recording medium used. For example, with respect to a transfer recording medium used in a transfer mode wherein transfer of an image is effected through heat-fusion of the image, the physical property may be a melting temperature, a softening temperature, a glass transition temperature, etc. With respect to a transfer recording medium used in a transfer mode wherein transfer of image is effected by making a transferable image viscous or penetrable into a transfer-receiving medium, the physical property may be a viscosity at the relevant temperature.

Figure 2A:
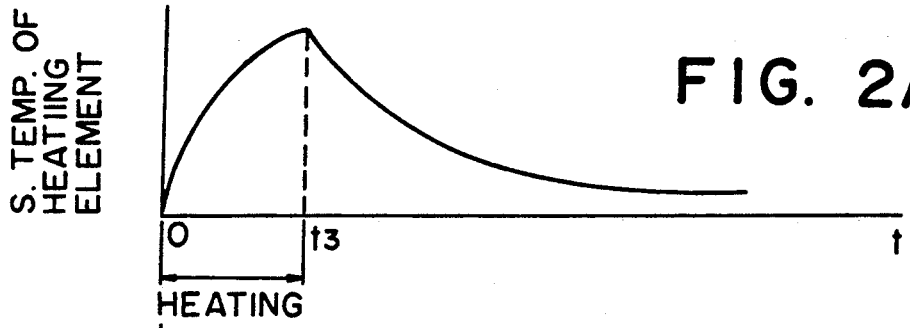
FIGS. 2A–2B show changes of several parameters with elapse of time involved in an image forming step using a transfer recording medium according to the present invention.
Figure 2B:
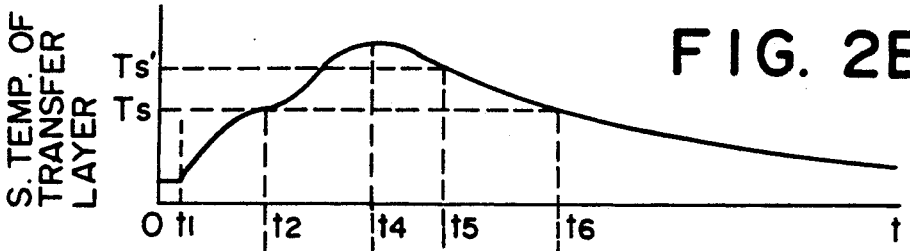

An image forming method suitable for using the recording medium of the present invention for image formation is explained with reference to FIGS. 2A–2D, wherein the abscissas are indicated on a common scale of time. The transfer recording layer contains a photo-initiator, a polymerizing component, etc., which will be explained hereinafter. FIG. 2A shows a surface temperature change of a heating element when a heating means such as a thermal head is energized for heat generation for a period of $0$–$t_3$ and subjected to temperature decrease thereafter. A transfer recording medium contacting the heating means under pressure causes a temperature change as shown in FIG. 2B corresponding to the temperature change of the heating means. More specifically, it starts to cause a temperature rise after a time delay of $t_1$ and similarly reaches the maximum temperature at time $t_4$ after time $t_3$, then followed by temperature decrease. The transfer recording layer has a softening temperature Ts and the viscosity thereof decreases in a temperature region above Ts. The change in viscosity is shown by a curve A in FIG. 2C. Thus, after the temperature reaches Ts at time $t_2$ and until it reaches the maximum temperature at time $t_4$, the viscosity continually decreases, while the viscosity again increases thereafter along with temperature decrease to show an abrupt increase in viscosity until time $t_6$ when the temperature decreases to Ts. In this case, the transfer recording layer has not been basically subjected to any material change and shows a decrease in viscosity in the manner as described above when it is heated above Ts in a subsequent transfer step.

Accordingly, if the transfer recording layer is caused to contact a transfer-receiving medium under pressure and subjected to heating required for transfer, e.g., to a temperature above Ts, the transfer recording layer is transferred in the same transfer mechanism as involved in the conventional thermal transfer recording. In this invention, however, when the transfer recording layer is illuminated or exposed to light from $t_2$ in parallel with heating as shown in FIG. 2D, and the temperature is sufficiently increased, the transfer recording layer softens and the reaction initiator, is actuated to provide a large reaction velocity, and a composition comprising at least one of a monomer, oligomer or prepolymer having an ethylenically unsaturated double bond rapidly causes hardening because of increased probability of polymerization.

The heated temperature may preferably be set to 70° C. or more, particularly 80° C. or more in order to provide a good result through rapid and stable reaction of changing the transfer characteristic.

Figure 2C:
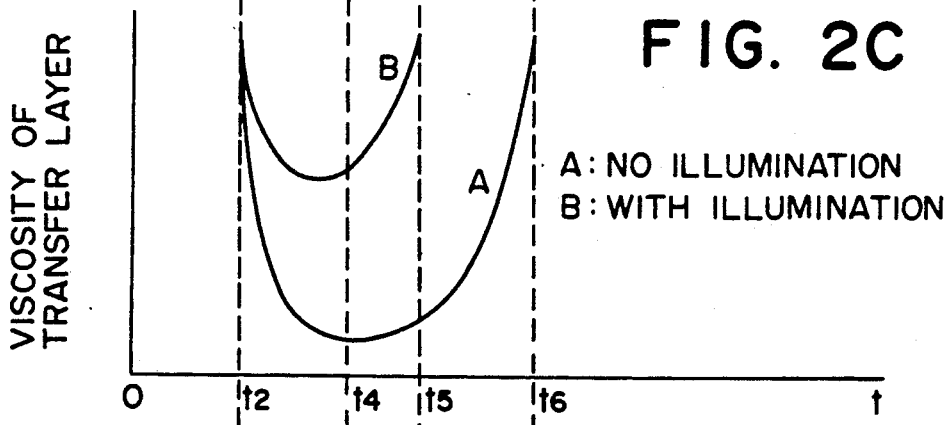
Figure 2D:
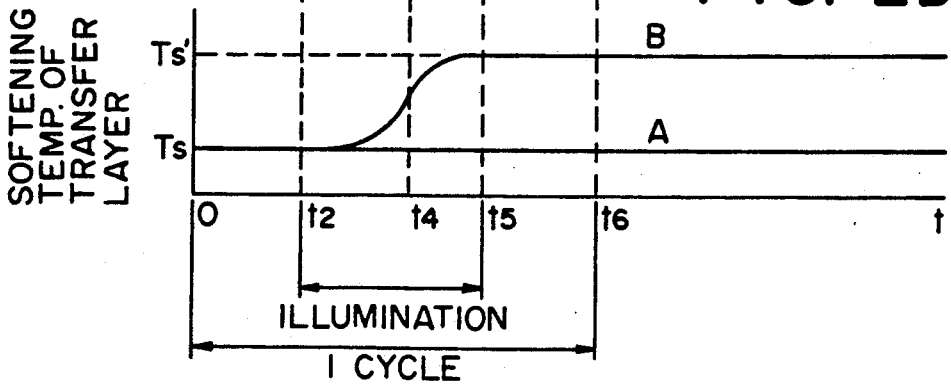

If heating and illumination are simultaneously carried out in this way, the transfer recording layer shows a viscosity change as represented by a curve B in FIG. 2C. Then, along with further progress of curing, the softening temperature is raised from Ts to Ts' at time $t_2$ when the curing is completed. Corresponding to this, the transfer recording layer is caused to have a different transfer initiation temperature, i.e., a temperature at which it starts to be transferred, from a certain temperature Ta to Ta'. The change in softening temperature as described above of the transfer recording layer is illustrated in FIG. 2D. As a result, the transfer recording layer has a portion having a transfer initiation temperature Ta' and also a portion retaining a transfer initiation temperature Ta which behave differently in a subsequent transfer step. Now, when the transfer recording layer is heated to a temperature Tr satisfying $Ta < Tr < Ta'$, the portion having a transfer initiation temperature Ta preferentially causes an abrupt decrease in viscosity to be selectively transferred to a transfer-receiving medium. In this instance, Ta'—Ta should preferably be about 20° C. or more, particularly 40° C. or more, while it somewhat depends on temperature stabilization accuracy during the transfer step. The value also holds true with a case of $Ts > Ts'$. In this way, a transferable image may be formed by controlling heating or non-heating in combination with simultaneous illumination, corresponding to an image signal.

The physical property controlling the transfer characteristic of the transfer recording layer may be a melting point or glass transition point in addition to the above-mentioned softening temperature. In any case, a transferable image is formed in the transfer recording layer through utilization of an irreversible change in physical property such as melting point and glass transition temperature. The softening temperature, melting temperature and glass transition temperature change with similar tendencies, so that the above explanation with respect to utilization of the softening temperature may also be an explanation with respect to utilization of a melting point or glass transition point.

As will be understood from the above description, the degree of irreversible change in transfer characteristic required for the transfer recording layer in the present invention is conveniently represented by a change in transfer initiation temperature. Herein, the transfer initiation temperature mentioned herein is a value measured by the following method A 6 μ-thick transfer recording layer formed on a 6 μ-thick polyethylene terephthalate (PET) film is caused to contact 0.2 mm-thick wood-free paper as a transfer-receiving medium having a surface smoothness (Bekk smoothness) of 50–200 seconds. The resultant laminate of the transfer recording medium and the paper is passed at a rate of 2.5 mm/sec between a pair of rollers as follows The first roller is a hollow cylindrical iron roller of 40 mm diameter in which a 300 W-halogen lamp heater is stored and is disposed on the side of the transfer recording medium. The second roller disposed on the side of the paper comprises a similar iron roller of 40 mm diameter coated with a 0.5 mm-thick fluorine rubber layer The two rollers are operated to exert a linear pressure of 4 kg/cm. In the measurement, the surface temperature of the first roller is measured by a temperature sensor, e.g., a thermistor, while controlling the halogen lamp heater to provide a prescribed temperature. At a time of 4 seconds after the laminate is passed through the two rollers, the transfer recording medium is peeled off the paper moved horizontally at a peeling angle of about 90° and at a rate equal to the conveying speed of the rollers, so that it is observed whether the transfer recording layer has been transferred onto the paper. The operation is continued while gradually raising the surface temperature of the first roller (at a rate of 10° C./min or less), and the minimum temperature at which the transfer starts to occur effectively (as identified by saturation of a transferred image density) is identified as the transfer initiation temperature of the transfer recording medium or the transfer recording layer.

In the above, the change in transfer characteristic has been explained as it is represented by a charge in glass transition temperature Tg, softening temperature Ts or melting temperature Tm. However, the recording medium according to the present invention may be sufficient if it changes its viscous state or penetration characteristic to the transfer-receiving medium in order to provide a recorded image through the following transfer step, so that it may be applicable even if a clear change in Tg, Ts or Tm as described above does not occur.

The combination of plural kinds of energies for producing a transferable image may suitably be light and heat or an energy convertible into heat selected from electric, ultrasonic and pressure in view of energy efficiency.

Next, formation of a multi-color image by the above recording method will be explained.

FIGS. 3A-3D are schematic partial sectional views showing a relationship between a transfer recording medium and a thermal head according to the present invention. In this embodiment, a heat energy modulated according to a recording signal is applied in combination with a light energy selected depending on the color of an image forming element of which the transfer characteristic is intended to be changed. Herein, "modulation" is an operation of changing a position to which the energy is applied corresponding to a given image signal, and "in combination" covers a case where the light energy and the heat energy are applied simultaneously as well as a case where the light energy and the heat energy are applied separately.

A transfer recording medium 1 shown in FIGS. 3A-3D comprises a transfer recording layer 3 disposed on a base film 2. The transfer recording layer 3 is formed as a layer of distributed particulate image forming elements. Respective image forming elements show different color tones. In the embodiment shown in FIGS. 3A-3D, for example, each image forming element contains any one colorant selected from magenta (M), cyan (C) and yellow (Y). The colorants to be contained in the image forming elements, however, are not restricted to magenta, cyan and yellow, but may be colorants of any color depending on an intended use. Each image forming element contains in addition to a colorant, a functional or sensitive component, of which the transfer characteristic changes when light and heat energies are applied thereto. The image forming elements may be formed on the substrate 2 together with a binder or by heat-melting the above components.

The functional component in the image forming elements has a wavelength dependency depending on the colorant contained. More specifically, an image forming element (M) containing a magenta colorant causes polymerization to be hardened or cured when a heat flux and a light beam with a wavelength (M) are applied thereto. Similarly, an image forming element (C) containing a cyan colorant and an image forming element (Y) containing a yellow colorant respectively cause polymerization to be hardened when a heat and a light beam with a wavelength λ (C) and heat, and a light beam with a wavelength λ (Y) and heat, respectively, are applied thereto. A cured or hardened image forming element does not cause decrease in viscosity even when heated in a subsequent transfer step, so that it is not transferred to a transfer-receiving medium. The heat and light are applied corresponding to an information signal to be recorded.

In this way, the transfer recording medium 1 is superposed on a thermal head 14 and light is illuminated so as to cover the entire heat generation region of the thermal head 14. The wavelengths of the illumination light are so selected sequentially as to react on image forming elements (M), (C) and (Y) to be illuminated. For example, if image forming elements (M), (C) and (Y) to be illuminated are colored in any one of magenta, cyan and yellow, light beams having a wavelength λ(M), λ(C) and λ(Y), respectively, are successively irradiated.

More specifically, while the transfer recording medium is illuminated with a light beam having a wavelength λ(M), resistance heating elements **14*b* and 14*c***, for example, of the thermal head are caused to generate heat. As a result, among the image forming elements (M) containing a magenta colorant, those applied with a heat and the light beam with a wavelength λ(M) are cured as shown by hatching in FIG. 3A (in FIGS. 3B, et seq., the cured elements are also indicated by hatching).

Figure 3A:
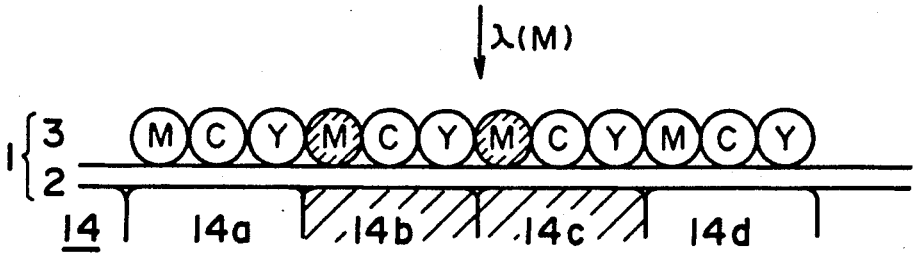
FIGS. 3A–3D are schematic partial sectional views showing a relationship between a transfer recording medium and a thermal head involved in a multi-color transfer recording mode using a transfer recording medium according to the present invention.
Figure 3B:
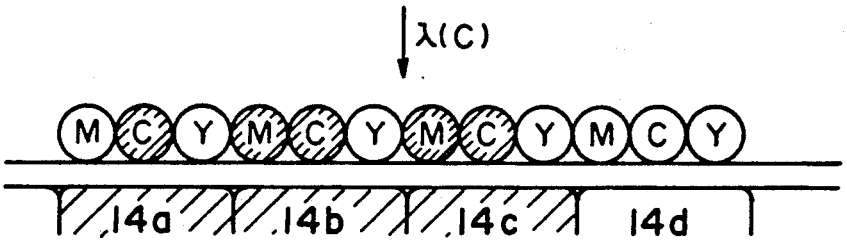
Figure 3C:
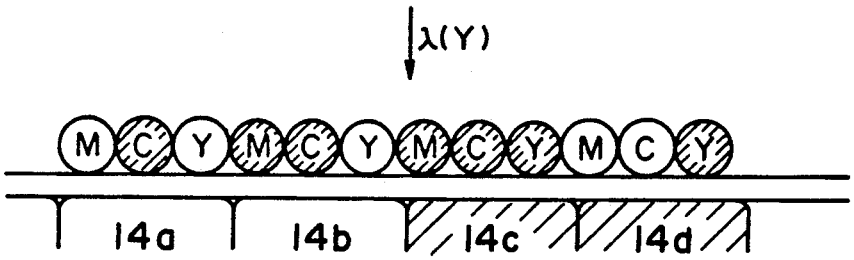
Figure 3D:
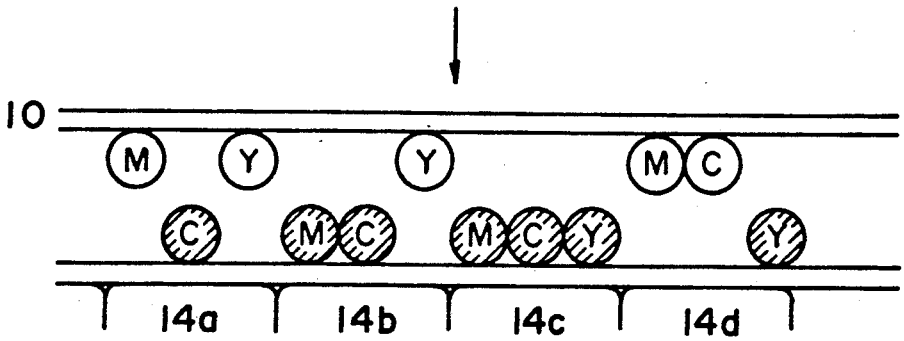
Figure 4:
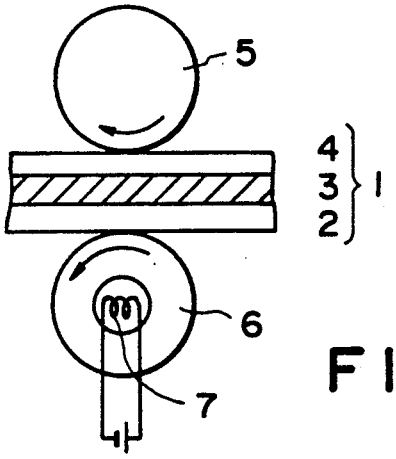
FIG. 4 illustrates means for contacting a transfer recording medium to a transfer-receiving medium and conveying the laminate under pressure by using heating and pressing rollers.

Then, as shown in FIG. 3B, while the transfer recording layer 3 is illuminated with a light beam with a wavelength λ(C), resistance heating elements **14*a*, 14*b* and 14*c* are caused to generate heat, whereby among the image forming elements containing a cyan colorant, those applied with the heat and the light beam with a wavelength λ(C) are cured. Further, as shown in FIG. 3C, while the light flux with wavelength λ(Y) is provided, resistance heating elements 14*c* and 14*d* are caused to generate heat, whereby among the image forming elements (Y), those applied with the heat and the light beam with a wavelength (Y) are cured to finally leave a transferable image formed of non-cured image forming elements in the transfer recording layer 3. The transferable image is then transferred to a transfer-receiving medium 10** in a subsequent transfer step as shown in FIG. 3D.

In the transfer step, the transfer recording medium on which the transferable image has been formed is caused to contact the transfer-receiving medium 10 through the faces and heat is applied from the transfer recording medium side or the transfer-receiving medium 10 side, whereby the transferable image is selectively transferred to the transfer-receiving medium 10 to form a visible image thereon. Accordingly, the heating temperature in the transfer step is so determined in connection with the change in transfer characteristics that the transferable image is selectively transferred. Further, in order to effectively carry out the transfer, it is also effective to apply a pressure simultaneously. The pressurization is particularly effective when a transfer-receiving medium having a low surface smoothness is used. Further, where the physical property controlling a transfer characteristic is a viscosity at room temperature, the pressurization alone is sufficient to effect the transfer.

The heating in the transfer step is suitable for producing a durable multi-color image with a stability and an excellent storability.

In the above embodiment explained with reference to FIGS. 3A to 3D, the entire area of the thermal head 14 is illuminated with light while resistance heating elements of the thermal head 14 are selectively energized. On the contrary, while a certain area of the transfer recording medium are uniformly heated, e.g., by energizing all the resistance heating elements of the thermal head 14 shown in FIGS. 3A–3D, light illumination may be effected selectively or imagewise to form a similar multi-color image. More specifically, light energy having a wavelength modulated according to a recording signal and selected depending on the color of an image forming element of which the transfer characteristic is intended to be changed, is imparted along with heat energy.

In the transfer recording medium according to the present invention, the adhesion force ($f_1$) between the support and the recording layer, and the adhesion force ($f_2$) between the recording layer and a transfer-receiving medium after they are contacted each other and passed through hot-pressure rollers, are required to satisfy the relations that $f_1 > f_2$ at a lower roller temperature and inversely $f_1 < f_2$ at a higher roller temperature, and that the relation of $f_1 < f_2$ at the higher roller temperature is inverted to $f_1 > f_2$ when the recording layer is exposed to a light beam with a wavelength region to which the functional component is sensitive at 100° C., and that if a minimum quantity of the light to provide $f_1 > f_2$ is taken as nJ/cm$^2$, the relation of $f_1 < f_2$ is retained even if the recording layer is exposed to the light with the above wavelength region in a quantity of $5 \times$nJ/cm$^2$, preferably $10 \times$nJ/cm$^2$, at a rollertemperature of 30° C.

Accordingly, the recording layer of the recording medium of the present invention becomes nontransferable to the transfer-receiving medium when it is provided with light energy and heat energy but remains transferable even if it is provided with a large quantity of light energy without supplying a substantial heat energy. For this reason, the recording medium according to the present invention is very excellent in environmental stability. If a relation of $f_1 \geqq f_2$ results when the recording layer is provided with a light energy of $5 \times$nJ/cm$^2$ with the above wavelength region, the recording medium is rather poor in environmental stability and is liable to cause white dropping in images.

In the image forming method explained with reference to FIGS. 3A–3D, a non-transferable image is formed when both heat and light energies are supplied simultaneously, and it is possible to prevent the reaction at unnecessary parts if both energies are scanned to be incident at a portion or a particulate image-forming element of which the transfer characteristic is to be changed. This is however liable to invite an increase in equipment cost. In the transfer recording medium of the present invention, however, the relation of $f_1 < f_2$ is retained even if a light energy is supplied at 30° C. in a quantity of $5 \times$nJ/cm$^2$ which is 5 times the minimum exposure quantity of providing $f_1 > f_2$ at 100° C. As a result, the light energy need not be provided by scanning but may be provided uniformly.

When a transfer recording layer is illuminated with a light energy, it is preferable to dispose a slit between the light source and the transfer recording layer to restrict the region of illumination of the recording layer to the region of heating in order to effectively cause the reaction of the transfer recording layer. Even if such a slit is provided, however, some leakage of light occurs outside the restricted region thereby, so that a peripheral portion outside a heated portion in the transfer recording layer is also illuminated. According to our study, the total amount of exposure light energy amounts to as large as 5 times the minimum exposure quantity when such illumination due to leakage of light is taken into account.

Thus, the transfer recording layer of the present invention retains the relation of $f_1 < f_2$ even if subjected to exposure in a quantity of $5 \times$nJ/cm$^2$ which is 5 times the minimum exposure quantity in a non-heated portion, so that a stable image can be formed without causing white dropping of images even if a peripheral portion outside the heated region is illuminated.

Herein, the relative magnitudes of the above adhesion forces $f_1$ and $f_2$ may be confirmed conveniently by the following method.

A transfer recording medium 1 is disposed in intimate contact with a transfer-receiving medium 4 (e.g., plain paper with a Bekk smoothness of 10–30 sec) and is passed between a heating roller 6 and a pressing roller 5. The heating roller 6 has a heater 7 inside thereof. A pressure of 25 kg/cm$^2$ is applied between the heating roller 6 and the pressing roller 5 at a constant nip width of 1 mm, and the temperature is set as desired. The transfer recording medium 1 and the transfer-receiving medium 4 after passing between the rollers 5 and 6 are not separated from each other but are set as they are on a tensile tester (Tensilon RTM-100, available from Toyo Boldwin K.K.) provided with a thermostat chamber capable of effecting a temperature control in the range of −60° to +270° C., so as to provide a peeling angle of 180°. Then, the transfer recording medium and the transfer-receiving medium are separated from each other to observe whether or not the recording layer is transferred, whereby the relative magnitude between $f_1$ and $f_2$ can be judged.

In this instance, the transfer or non-transfer of the recording layer can be judged by measuring the change in color thereof due to a colorant contained therein. In a specific example, a transfer recording medium having a recording layer containing 7 wt. % of carbon black showed an optical density of 1.3 as measured by a McBeth optical densitometer RD-514. The transfer recording medium and a transfer-receiving medium were passed between heating and pressing rollers set to a temperature of 40° C. and set on the tensile tester with a thermostat chamber temperature of 40° C., followed by peeling in the above described manner. As a result, the transfer recording layer remained on the support without transfer to provide an optical density of 1.3 (showing $f_1 > f_2$) On the other hand, the same transfer recording medium and transfer-receiving medium were passed between the heating and pressing rollers set to 150° C. and separated from each other at a thermostat chamber temperature of 150° C., whereby the transfer recording layer was transferred to leave the transfer recording medium showing an optical density of 0.1 ($f_1 < f_2$). From an experiment as described above, the relative magnitudes of the adhesion force ($f_1$) between a support and a recording layer and the adhesion force ($f_2$) between the recording layer and a transfer-receiving medium can be measured easily at different temperatures of the heating and pressing rollers.

On the other hand, relative magnitudes after illumination at a constant temperature may be evaluated in the following manner.

A transfer recording layer is coated with an aqueous solution of polyvinyl alcohol for minimizing the influence of oxygen hindering the polymerization of the functional component and dried. The thus treated sample of a transfer recording layer is placed on a hot plate heated at 100° C. and illuminated with ultraviolet rays from a high-pressure mercury lamp placed 10 cm spaced apart for a prescribed period. Then, the polyvinyl alcohol film is removed from the sample by washing with water, and the sample and a transfer-receiving medium are together passed between heating and pressing rollers, followed by measurement in the above described manner to evaluate the relative magnitudes of $f_1$ and $f_2$. The transfer recording medium of the present invention shows a relation of $f_1<f_2$ when passed between heating and pressing rollers set to 150° C. without illumination but becomes non-transferable as the exposure quantity of light illumination increases ($f_1>f_2$) By repeating the above procedure for evaluation of relative magnitudes $f_1$ and $f_2$ for a sample while varying the exposure quantity, the minimum exposure quantity n J/cm$^2$ for providing $f_1>f_2$ can be easily determined for each sample. Then, the same sample is exposed to the light of the same wavelength region in a quantity of $5\times n$ J/cm$^2$ at 30° C., followed by passing between heating and pressing rollers set to 150° and evaluation of the relative magnitudes between $f_1$ and $f_2$ to confirm the relation of $f_1<f_2$. Herein, for the evaluation of relative magnitudes between $f_1$ and $f_2$, the ratio of the optical density of a transfer recording medium after peeling to the optical density of the transfer recording medium before the measurement provides standards such that the ratio of 70% or above defines $f_1>f_2$, and the ratio of below 30% defines $f_1<f_2$.

From the above measurements, parameters characterizing the transfer recording medium of the present invention may be obtained, such as the relative magnitudes between the adhesion force $f_1$ between the support and the recording layer and the adhesion force $f_2$ between the recording layer and the transfer-receiving medium, and the changes of the relative magnitudes of the $f_1$ and $f_2$ due to temperature change and due to illumination.

The transfer recording medium according to the present invention may comprise a support 2 and a recording layer 3 which may be in the form of a uniform layer as shown in FIG. 1 or may comprise a layer of distributed particulate image-forming elements as shown in FIGS. 3A–3D. The particulate image-forming elements can take a microencapsulated form. In case where the particulate elements are in the form of microcapsules, the adhesion force $f_1$ is defined as one between the support and capsule shells or one between a capsule-carrying layer formed on the support and capsule shells. Further, the adhesion force $f_2$ is taken as one measured by scraping or removing a port of the shell material with a scraping roller and then measuring an adhesion force acting between the capsule cores and the transfer-receiving medium.

Figure 5:
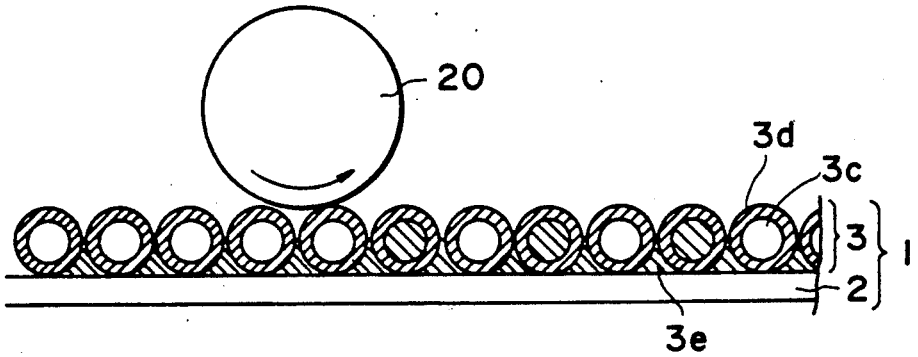
FIG. 5 is a view showing a laminar structure of image-forming elements in the form of capsules containing a colorant and a functional component carried on a support together with a scraping roller for scraping capsule shells.

FIG. 5 shows a mode of scraping a part of the shell material with such a scraping roller 20. The transfer recording medium 1 comprises a support 2 and a recording layer 3 comprising capsule particles carried on the support with a binder layer **3*e*, each capsule enclosing a recording material 3*c* with a shell material 3*d*. The adhesion force $f_2$ acting between the recording layer 3** and a transfer-receiving medium depends on a contact area therebetween but it is sufficient that the contact area is the same at the instants of comparison of $f_1$ and $f_2$ The same contact area for this purpose may be substantially accomplished by uniforming the material and the rotational speed of the scraping roller, and the contact pressure between the transfer-receiving medium and the scraping roller.

For example, a constant contact area is obtained by using a scraping roller formed by sand-blasting a stainless steel shaft with a diameter of 14 mm to form a minute unevenness, affixing the roller to exert a pressure of 0.2 kg/cm onto a transfer recording medium, rotating the roller at 1000 rpm, and moving the transfer recording medium at a rate of 300 mm/sec in a counter direction to the rotation direction of the scraping roller.

Further, in case where encapsulated image forming elements containing different combinations of functional components and colorants sensitive to different wavelength regions are carried at random on a support, relative magnitudes of $f_1$ and $f_2$ for respective elements containing respective colorants can be judged by measuring changes in optical density of color fractions corresponding to the respective colorants.

The above described relative magnitudes of the adhesion force $f_1$ between a support and a recording layer, and the adhesion force $f_2$ between the recording layer and a transfer-receiving medium are explained with reference to FIGS. 6A and 6B.

Figure 6A:
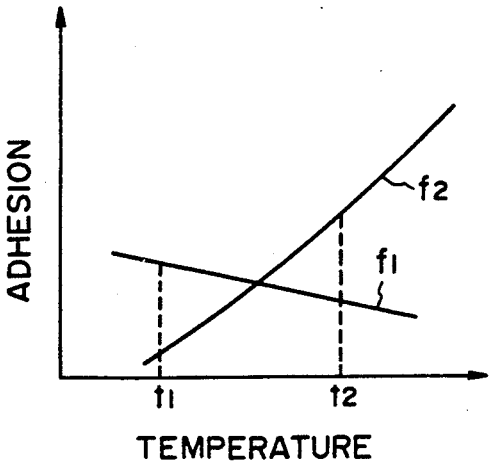
FIG. 6A is a graph showing the temperature-dependency of an adhesion force $f_1$ between a support and a recording layer, and an adhesive force $f_2$ between the recording layer and a transfer recording layer.

FIG. 6A shows changes of $f_1$ and $f_2$ due to a temperature change. The transfer recording medium of the present invention comprises a polymerizable monomer, oligomer or prepolymer which is solid at room temperature in its recording layer, and the adhesion force ($f_1$) between the recording layer and the support decreases on temperature increase. On the other hand, the adhesion force ($f_2$) between the recording layer and a transfer-receiving medium increases gradually from a temperature in the neighborhood of the softening temperature of the polymerizable monomer, oligomer or prepolymer or a binder component contained therein. As a result, the relation of $f_1>f_2$ holds in a lower temperature region and the relation of $f_1<f_2$ holds in a higher temperature region, thus resulting in an inversion of the relative magnitudes.

Figure 6B:
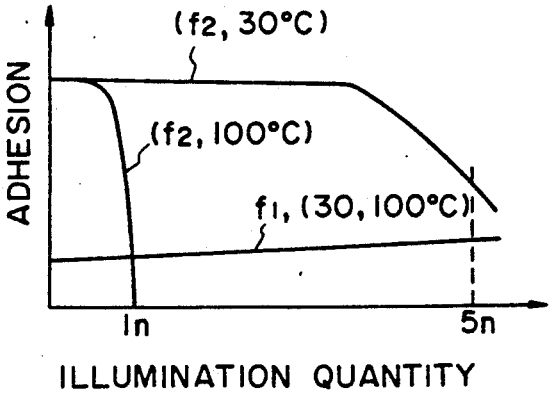
FIG. 6B is a graph showing the illumination quantity-dependency of the adhesion forces $f_1$ and $f_2$ and showing the concept of the present invention.

FIG. 6B shows relations of the adhesion forces $f_1$ and $f_2$ at a higher temperature versus the illumination quantities at 30° C. and 100° C. The adhesion force ($f_1$) between the support and the recording layer slightly increases as the illumination or exposure quantity increases. On the other hand, the adhesion force ($f_2$) between the recording layer and the transfer-receiving medium rapidly decreases in the case of 100° C. but gradually decreases in the case of 30° C. As a result, the inverted relation of $f_1>f_2$ occurs at a minimum exposure quantity of nJ/cm$^2$ for illumination at 100° C. but the relation of $f_1<f_2$ is retained even at an exposure quantity of $5\times n$ J/cm$^2$ for illumination at 30° C.

In an image-forming method suitable for using the transfer recording medium of the present invention, image formation is effected by utilizing differences in changes of relative magnitudes of the adhesion force ($f_1$) between the support and the recording layer and the adhesion force ($f_2$) between the recording layer and the transfer-receiving medium between the cases of illumination under heating temperature and illumination under no heating. The case of no heating refers to, e.g., a case where heating means are not energized and the temperature thereof may generally be assumed to be room temperature or a temperature in an image-forming apparatus which may be represented by 30° C. On the other hand, the case of heating refers to a case where heating means are energized and the temperature thereof can change in a variety. As the transfer recording medium of the present invention contains a polymerizable component such as a monomer, oligomer or prepolymer, excessive heating providing a temperature of above 100° C. can cause gradual polymerization even without illumination to result in formation of a non-transferable image. For this reason, it is preferred that the temperature under heating is represented or replaced by 100° C.

Figure 7:
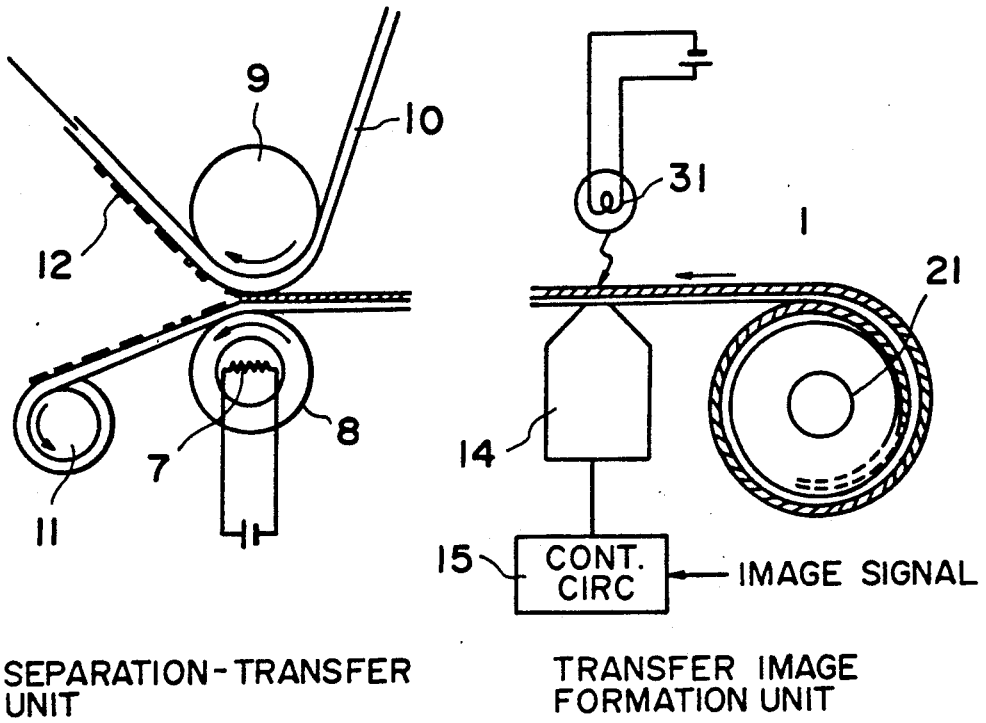
FIG. 7 illustrates an image-recording apparatus using a transfer recording medium of the present invention.

FIG. 7 illustrates an example of apparatus for practicing the image-forming process suitable for using the transfer recording medium of the present invention. More specifically, the apparatus shown in FIG. 7 is used for practicing a mode of the image-forming method wherein a plurality of heating elements in a single heating means are selectively energized corresponding to given image signals, and light rays having wavelength different dependent on colors of images to be record are incident to at least portions of the heating elements thus energized. Referring to FIG. 7, a transfer recording medium 1 according to the present invention comprises a film substrate 2 and a transfer recording layer 3 formed thereon. The transfer recording medium 1 is wound about a feed roller 21. An illumination means 31 disposed to illuminate the transfer recording medium 1 with light may be a low-pressure mercury lamp, a high-pressure mercury lamp, a metal halide lamp, a fluorescent lamp, a xenon lamp, etc. Opposite to the illumination means 31 with respect to the transfer recording medium 1 is disposed a heating means 14 such as a thermal head which is controlled by a control circuit 15 to generate heat pulses. Instead of an ordinary thermal head, a current-conduction type self-heat generative transfer recording medium which generates heat due to a current passing therethrough may also be used. In this case, the heating means 14 is composed as a current head which generates electric pulses passing through the medium. The heating means 14 is provided with a plurality of heating elements (equal to resistance heating elements shown in FIGS. 3A–3D when the heating means is a thermal head, and unit electrodes when the heating means is a current head). The heating elements may be arranged in a single row, in matrix or in a plurality of rows. Further, the heat elements may respectively be discrete ones, or may be parts of a continuous bar-shaped resistance heating member provided with discrete electrodes.

The apparatus further includes transfer means comprising a heat roller 8 provided with a heater 7 inside thereof and a pinch roller 9 disposed opposite to the heat roller 8 so as to pinch a laminate of the transfer recording medium 1 and a transfer-receiving medium 10 such as plain paper or an OHP sheet (overhead projection transparency), and a windup roller 11 about which the transfer medium 1 after the transfer operation is wound up. The recorded image 12 corresponding to the transferable image is transferred from the transfer medium 1 and formed on the medium 10.

The transfer medium 1 sent from the supply roller 21 is applied with heat pulses by the thermal head 14 based on image signals supplied to the control circuit 15. Simultaneously with the application of heat pulses to the transfer medium 1, different wavelengths of light are successively issued from the lamp 31 in synchronism with the heat pulses based on the (color) image signals. The principle of transferable image formation is the same as explained with reference to FIGS. 3A to 3D. The lamp 31 in the figure is schematically depicted and may be composed of a plurality of lamps issuing different wavelengths of light. More specifically, if one spectral region of light is supplied from one lamp, lamps are required in a number equal to that of the colors of the image forming elements.

A transferable image portion is formed in the transfer recording layer 1*a* by means of the thermal head 4 and the lamp 3 and is transferred to the transfer-receiving medium 10 when passed through the heat roller 8 and the pinch roller 9.

In this case, basically a single selective heating means such as a thermal head is controlled based on image signals, so that the control circuit can be made a simple one. As a result, it is easy to realize a small-sized highly reliable apparatus and also stable image formation.

Formation of a multi-color image has been explained in the above, but a monocolor image can also be obtained by the apparatus shown in FIG. 7, if a single colorant is used in the transfer recording layer. This is also true with the apparatus which will be explained hereinafter.

The coloring component or colorant contained in the recording layer is a component to provide an optically recognizable image and may be appropriately selected from various pigments and dyes. Specific examples of the colorant include: inorganic pigments such as carbon black, lead yellow, molybdenum red, and red iron oxide; organic pigments such as Hansa Yellow, Benzidine Yellow, Brilliant Carmine 6B, Lake Red C, Permanent Red F5R, Phthalocyanine Blue, Victoria Blue Lake, and Fast Sky Blue; leuco dyes, and phthalocyanine dyes.

The functional component may be a monomer, oligomer or prepolymer having an unsaturated double bond inclusive of epoxy acrylates, urethane acrylate, oligoester acrylates, diallyl phthalate resin, and rubbers such as butadiene and isoprene oligomers. More specifically, examples of the functional component include: ethylene glycol diacrylate, ethylene glycol dimethacrylate, trimethylolpropane trimethacrylate, pentaerythritol tetraacrylate, pentaerythritol tetramethacrylate; epoxyacrylates synthesized by reaction of acrylic acid or methacrylic acid with epoxy compounds which in turn are obtained through reaction of epichlorohydrin with polyhydric alcohols, such as bisphenol A, hexanediol and cresol movolak resin: urethane acrylates synthesized through reaction of isocyanate compounds such as toluene diisocyanate, hexamethylene diisocyanate, cyclohexylene diisocyanate, 4,4'-diphenylmethane diisocyanate, and 4,4'-dicyclohexylmethane diisocyanate with acrylic compounds, such as 2-hydroxyethyl acrylate, 2-hydroxyethyl methacrylate, 2-hydroxypropyl acrylate, and 2-hydroxypropyl methacrylate; poly(o-diallyl phthalate), poly(isodiallyl phthalate), butadiene rubber, isoprene rubber, cyclized isoprene rubber; and prepolymers obtained through reaction of a polymer compound containing acrylic or methacrylic acid unit with a compound, such as glycidyl methacrylate, acrylic acid chloride, or methacrylic acid chloride.

The recording layer may further contain a binder component which may be composed of a polymer compound, such as acrylic resin, styrene resin, vinyl chloride resin, chlorinated olefin resin, polyester resin, and amide resin. The recording layer may further contain a photoinitiator, which may for example be selected from carbonyl compounds, halogen compounds, organic sulfur compounds, azo compounds, and peroxides. Examples of the carbonyl compounds include: α-diketones, such as benzyl, 4,4'-dimethoxybenzyl, camphorquinone, and acenaphthenequinone; benzoin and benzoin derivatives, such as benzoin methyl ether, benzoin isopropyl ether, benzyl dimethyl ketal, benzyl diethyl ketal, and benzyl dimethoxyethyl ketal; acetophenone and acetophenone derivatives, such as 2,2-diethoxyacetophenone, 2-hydroxy-2,2-dimethylacetophenone, 4'-isopropyl-2-hydroxy-2-methylpropiophenone, 4'-methylthio-2-morpholino-propiophenone, and chlorinated acetophenone; benzophenone and benzophenone derivatives, such as methyl-o-benzoylbenzoate, 4,4'-dichlorobenzophenone, 3,3'-dimethyl-4-methoxybenzophenone, Michler's ketone; thioxanthone, and thioxanthone derivatives such as 2-methylthioxanthone, 2-isopropylthioxanthone, 2,4-diethylthioxanthone, 2-chlorothioxanthone, and thioxanthones as disclosed by Japanese Laid-Open Patent Appln. No. 154970/1980 (Ciba-Geigy GmbH); cumarine deratives as disclosed by Japanese Laid-Open Patent Appln. No. 42684/1984, chalcone and styryl styryl ketone derivatives, and also 1-hydroxycyclohexyl phenyl ketone, xanthone, fluorenone, and anthraquinone.

Examples of the halogen compounds include: aromatic sulfonylchlorides, such as anthraquinonesulfonyl chloride, quinolinesulfonyl chloride, and 2-sulfonyl chloride thioxanthone, and S-triazines having trihalomethyl groups, chlorine-substituted 2,4,5-triphenyl imidazolyl dimer, and carbon tetrachloride.

Examples of the organic sulfur compounds include: dibenzothiazolyl sulfide, decyl phenyl sulfide, disulfides, and imidazole derivatives having a mercapto group.

Redox-type photoinitiators utilizing metal ions, organometal complexes or photoreductive colorants can also be used.

The recording layer can further contain a stabilizer such as hydroquinone, p-methoxyphenol, p-tert-butylcatechol, or 2,2'-methylene-bis(4-ethyl-6-tert-butylphenol).

In the transfer recording medium of the present invention, the recording layer may be prepared from the materials as described above to have a glass transition temperature (Tg) of preferably 30°-150° C. The Tg of the recording layer may be measured in the following manner.

A recording layer is dissolved in chloroform and the solution is applied onto a 100 μm-thick aluminum plate to form a 10 μm-thick layer. The coated plate is set in a thermal mechanical analysis (TMA) apparatus SSC-580 to measure the glass transition temperature under the conditions of a load of 1 kg/cm$^2$ and a temperature-raising rate of 10° C./min.

The monomer oligomer or prepolymer as the functional component may preferably be contained in a proportion of 30-95 wt. % in the transfer recording layer. Further, it is preferred that the transfer recording layer contains 0.1-20 wt. % of a photoinitiator, 0.1-25. % of a colorant and 0-60 wt. % of a binder component.

When the image forming elements constituting the transfer recording layer is provided in the form of microcapsules, the core of the capsules may be formed of the above mentioned materials for the transfer recording layer. On the other hand, the wall of the microcapsules may for example be formed of a material including gelatine, gum arabic, cellulosic resins such as ethyl cellulose, and nitrocellulose, polymers such as urea-formaldehyde resin, polyamides, polyesters, polyurethane, polycarbonate, maleic anhydride copolymers, polyvinylidene chloride, polyvinyl chloride, polyethylene, polystyrene, and polyethylene terephthalate.

The recording layer may preferably be formed in a thickness of 1-20 μ, particularly 3-10μ. When the recording layer comprises particulate image forming elements including those in the form of microcapsules, it is preferred that the image forming elements have a particle size of 1-20μ, particularly 3-15μ. The image forming elements may preferably have a particle size distribution in the range of within ±50%, particularly within ±20%, from the number-average particle size thereof. In case where the image forming elements are in the form of microcapsules, the shell thickness may preferably be 0.1-2.0μ, particularly 0.1-0.5μ.

The image-forming elements in the form of microcapsules may be bound to the support of the transfer recording medium by using an adhesive such as that of polyvinyl alcohol (PVA), epoxy-type, polyvinylpyrrolidone, polyacrylamide, polyester-type, urethane resin-type, acrylic-type, urethane-acrylictype, or ethylene-vinyl acetate copolymer-type. The adhesive may preferably be applied in a thickness of 0.1-1μ.

In order to constitute the transfer recording medium according to the present invention into one adapted for use in multi-color image formation, the image forming elements containing different colorants may preferably have sensitivities to different wavelengths. As described hereinbefore, when the transfer recording layer is composed of a number (n) of colors of image forming elements, the image forming elements should preferably contain n types of functional components allotted to respective colors and each providing an abruptly changing reaction velocity when irradiated with a particular wavelength of light. These functional components in combination of n kinds are respectively contained in the image forming elements which are distributed to form a transfer recording layer. Examples of such a combination include, as a combination for a two-color recording system, one comprising:

a photo-initiator sensitive to about 400-500 nm, such as:

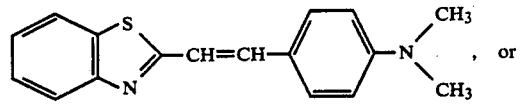

, or

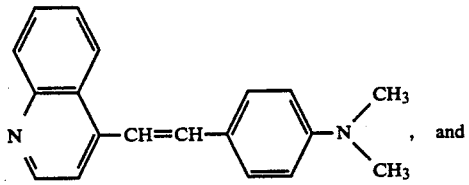

, and a photo-initiator sensitive to about 480-600 nm, such as:

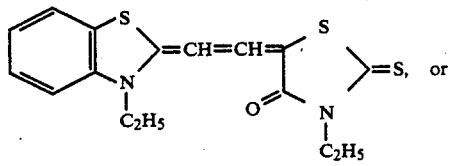

or

-continued

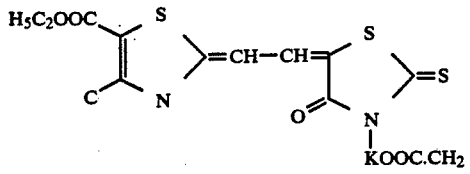

In this case, the sensitivity regions of the above two types of photo-initiators overlap each other in the region of 480–500 nm, but this is a low sensitivity region to both types of photo-initiators. Thus, they can be almost completely separated from each other, if necessary, by using appropriate light sources.

Sensitivity separation adapted for three color image forming element system may be provided by using an azo compound having a sensitivity to 340–400 nm or a halogen compound having a sensitivity to 300–400 nm in combination with the above photo-initiators, so that a full-color recording system may be developed.

Further, as a combination of photo-initiators, one of (a) 2-chlorothioxanthone/ethyl p-dimethylaminobenzoate, and (b) dichlorobenzophenone/ethyl p-dimethylaminobenzoate, may also be used. Light sources of $\alpha$ a fluorescent light having a peak wavelength of 390 nm and $\beta$ a fluorescent light having a peak wavelength of 313 nm may be used in combination with the above combination of the photo-initiators. In order to provide the same degree of reaction (i.e., the same transfer density level), the required illumination energy level is assumed to be 1 (standard) for a combination (1)- $\alpha$, 4 (times) for (a)- $\beta$, 1.1 for (b)- $\beta$, and 5 for (b)- $\alpha$. As a result, if the light source - $\alpha$ is used at the illumination energy level of 1 and the light source $\beta$ is used at the illumination energy level of 1.1, the photoinitiator systems (a) and (b) can be separately activated so as to provide substantially the same reaction degree.

Further, even in a case where the functional components contained in the image forming elements have substantially the same spectral sensitivity or wavelength dependency, the respective image forming elements can have different spectral sensitivities due to different filter effects of colorants contained therein. For example, a blue colorant transmits and reflects wavelengths of about 400–500 nm for blue light and absorbs the region of 500–700 nm for green to red light. Accordingly, an image forming element containing a blue colorant has a sensitivity to blue light. For the same reason, an image forming element containing a red colorant has a sensitivity to red light. Thus, even if image forming elements contain a functional component sensitive to a blue-red spectral range, they can have separate sensitivities because of the colorants contained therein.

In the transfer recording medium used in the present invention, it is possible that the radical reactivity of the transfer recording layer is suppressed because of oxygen in the air. In order to obviate this difficulty, it is preferred to provide an oxygen-shielding layer by applying an aqueous polyvinyl alcohol solution containing a small amount of a surfactant on the transfer recording layer. The oxygen-shielding layer may be removed after the latent image formation by washing with water. In case of image forming elements in the form of microcapsules, it is possible to have the walls show a function of the oxygen-shielding layer.

The color transfer recording medium used in the present invention may for example be produced in the following manner.

The various components forming the transfer recording layer such as the functional component, binder component, stabilizer, colorant, etc., may be melt-mixed and coated on a substrate such as a polyimide film by means of an application, etc., to form a transfer recording medium. In case where the transfer recording layer is formed of image forming elements of multi-colors, for example, the above components may be mixed and formed into minute image forming elements by spray drying, etc., for respective colors, and the resultant image forming elements of respective colors are sufficiently mixed with a binder such as a polyester resin in a solvent such as methyl ethyl ketone and ethylene glycol diacetate and coated by a solvent-coating method onto a substrate such as a polyimide film, followed by drying, e.g., at 80° C. for 3 minutes to remove the solvent to form a transfer recording layer. Thus, a desired transfer recording medium may be obtained.

Alternatively, a transfer recording medium can also be formed by applying an adhesive as described above on a substrate and disposing the image-forming elements on the substrate.

In a case where the image forming elements are in the form of microcapsules, they may be bound to a substrate by a method similar to one as described above with reference to the minute or particulate image forming elements.

The substrate or support to be used in the transfer recording medium according to the present invention is not particularly limited, but may be known material such as polyester, polycarbonate, triacetylcellulose, nylon, polyimide, polyethylene terephthalate, and aramide resin in the form of, e.g., a film or sheet.

Hereinbelow, the present invention will be explained by way of Examples.

EXAMPLE 1

TABLE 1

| Category | Component | wt.% |
|---|---|---|
| Polymerizing component | Reaction product between 4,4'-dicyclohexylmethane diisocyanate and 2-hydroxyethyl acrylate | 70 |
| Binder component | Polymethyl methacrylate (BR-88, available from Mitsubishi Rayon K.K.) | 20 |
| Photo-initiator | 2-Chlorothioxanthone (Tokyo Kasei K.K.) | 1 |
| | Ethyldimethylamino benzoate | 2 |
| Colorant | Carbon black | 7 |

25 parts of dicyclohexylmethane diisocyanate (available from Tokyo Kasei K.K.) was dissolved in 50 parts of tetrahydrofuran, and 30 parts of 2-hydroxyethyl acrylate and 1 part of p-methoxyquinone were added thereto, followed by refluxing at 60° C. for 10 hours. The reaction liquid was poured in 500 parts of a 2N-NaOH aqueous solution, and the mixture was vigorously stirred. After that, the upper oil layer was recovered by means of a separating funnel and poured into 500 parts of n-hexane to recover and dry the precipitated solid. As a result of analysis by IR (infrared) and NMR (nuclear magnetic resonance), the solid was confirmed to be an urethane acrylate formed by reaction between 4,4'-cyclohexylmethane diisocyanate and 2-hydroxyethyl acrylate. The melting point of the urethane acrylate was found to be about 70° C. as measured by DSC-7 available from Perkin Elmer Co.

The components shown in the above Table 1 including the urethane acrylate as obtained above were dissolved in tetrahydrofuran and applied in a thickness of 4 μm onto a 6 μm-thick polyethylene terephthalate film by solvent coating, followed by drying to obtain a transfer recording medium according to the present invention, which is herein referred to as a "sample".

The sample was introduced into the separation-transfer unit of an apparatus as shown in FIG. 7, and superposed on plain paper having a surface smoothness in the range of 10–30 sec. so as to contact the plain paper with its recording layer side. The laminate was conveyed between a heat roller 8 and a pinch roller 9. The heat roller 8 was an aluminum roller having a 300 W-heater inside thereof and covered with a 2 mm-thick silicone rubber layer. The surface temperature of the heat roller 8 was controlled at 40° C. by the heater. The pinch roller 9 was one made of silicone rubber (having a hardness of 50° according to measurement by JIS rubber hardness meter) and controlled to exert a pressure of 25 kg/cm$^2$.

The laminate thus treated was directly set in a tensile strength tester (Tensilon RTM-100, mfd. by Toyo Baldwin K.K.) so as to provide a peeling angle of 180°. Then, the sample chamber was brought to 40° C., and the sample and the plain paper were peeled from each other at a peeling speed of 300 mm/sec. The optical densities of the sample before and after the above conveying operation were measured to be both 1.3 as measured by an optical densitometer McBeth RD-514.

From the above examination, the adhesion force $f_1$ between the support and the recording layer and the adhesion force $f_2$ between the recording layer and the plain paper (transfer-receiving medium) was judged to satisfy the relation of $f_1 > f_2$ when the sample (transfer recording medium) was passed between the heating and pressing rollers.

Then, the sample and the plain paper was passed between the same heating and pressing rollers which were however set to 150° C. and they were separated from each other in a thermostat chamber temperature of 150° C. otherwise in the manner described above. In this case, the optical density of the transfer recording medium after peeling was measured to be 0.1, thus showing the relation of $f_1 < f_2$.

Then, an aqueous solution of polyvinyl alcohol (M.W. = 1200) was applied on the recording layer of the above transfer recording medium by solvent coating method to form a 10 μm-thick oxygen-shielding layer, whereby a new sample (transfer recording medium) was obtained. The sample was placed on a hot plate heated at 100° C. and illuminated with ultraviolet rays from a 2 KW-high-pressure mercury lamp disposed 10 cm spaced apart for a variety of prescribed periods. Then, the oxygen-shielding PVA (polyvinyl alcohol) layer was removed by washing with water.

When a sample thus illuminated for 35 msec was superposed on plain paper, passed together between heating rollers at 150° C. and peeled from the plain paper, the sample after peeling provided an optical density of 1.2, thus showing the relation of $f_1 > f_2$. On the other hand, a sample illuminated for 30 msec provided an optical density of 0.2, thus showing the relation of $f_1 < f_2$.

Then, the PVA-coated sample was placed on a hot plate set to 30° C. and illuminated with the above ultraviolet rays for a period of 175 msec (35 msec × 5), followed by removal of the PVA film, passing between rollers heated to 150° C. and peeling. The sample after the above operation gave an optical density of 0.2, thus showing the relation of $f_1 > f_2$.

Then, a sample transfer recording medium prepared in the above described manner was wound up in a roll and set in the transfer image-formation unit of an apparatus as shown in FIG. 7.

The thermal head 14 was one of a line type of 8 dots/mm—A4 size having a row of resistance heating elements at its edge portion. The thermal head 14 was disposed so as to contact the base film side of the transfer medium 1 and in such a manner that the transfer medium 1 was pressed to the heating elements due to a tension applied to the transfer medium. Opposite to the thermal head 14 and 2 cm spaced apart from the transfer medium 1 was disposed a high pressure mercury lamp 31.

Then, the thermal head 14 was energized while being controlled based on image signals. In this example, the parts of the transfer recording layer 1a increased glass transition point, whereby a negative type of recording was effected. More specifically, the thermal head 4 was controlled in such a manner that it was not energized in response to a mark signal (black) but was energized in response to a non-mark signal (white) to generate heat at a current energy of 0.8 W/dot × 2.0 msec. In this way, while effecting uniform illumination with a high pressure mercury lamp, the thermal head was driven under control based on image signals at a repetition cycle of 5 msec/line, in phase with which the transfer recording medium was conveyed by means of a stepping motor and a driving rubber roller.

Then, the PVA film was removed and the transfer recording medium was superposed on a transfer-receiving paper. The resultant laminate was then introduced into the separation-transfer unit of the apparatus shown in FIG. 7 and passed between the heating rollers, followed by separation of the transfer recording medium or the support thereof, whereby a high quality image was formed with a good fixation characteristic on the transfer-receiving paper.

EXAMPLE 2

TABLE 2

| Category | Component | wt.% |
|---|---|---|
| Polymerizing Component | Reaction product between 4,4'-dicyclohexylmethane diisocyanate and 2-hydroxyethyl acrylate | 70 |
| Binder component | Polymethyl methacrylate (BR-88, available from Mitsubishi Rayon K.K.) | 20 |
| Photo-initiator | 2-Chlorothioxanthone (Tokyo Kasei K.K.) | 1 |
| | Ethyldimethylamino benzoate | 2 |
| Colorant | Diaresin Red K (Mistubishi Kasei Kogyo K.K.) | 7 |

TABLE 3

| Category | Component | wt.% |
|---|---|---|
| Polymerizing component | Reaction product between 4,4'-dicyclohexylmethane diisocyanate and 2-hydroxyethyl acrylate | 70 |
| Binder component | Polymethyl methacrylate (BR-88, available from Mitsubishi Rayon K.K.) | 20 |
| Photo-initiator | Irgacure 184 (Ciba-Geigy Corp.) | 1 |
| | Ethyldimethylamino benzoate | 2 |

TABLE 3-continued

| Category | Component | wt.% |
|---|---|---|
| Colorant | Diaresin Yellow | 7 |

The compositions shown in the above Tables 2 and 3 were respectively microencapsulated in the following manner.

Each of the compositions shown in Tables 2 and 3 in a quantity of 10 parts was mixed with 20 parts of methylene chloride. The mixture was mixed with a solution of a cationic or nonionic surfactant having an HLB value of at least 10 and 1 g of gelatine in 200 ml of water, and the resultant mixture was stirred by means of a homomixer at an elevated temperature of 60° C. to form an emulsion containing oil droplets with an average particle size of 26 μm.

The emulsion was further stirred at 60° C. for 30 min. to evaporate the methylene chloride to provide an average particle size of 10 μm. A solution of 1 g of gum arabic in 20 ml of water was added thereto, and the system was gradually cooled with addition of an $NH_4OH$ aqueous solution (ammoniacal water) to a pH of above 11, therefore to form a slurry of microcapsules. Then, 1.0 ml of a 20% aqueous solution of glutaraldehyde was slowly added to harden the capsule walls.

Then, the slurry was subjected to solid-liquid separation by a Nutsche funnel to recover the capsules, which were then dried under vacuum at 35° C. for 10 hours to obtain image forming elements in the form of microcapsules.

The thus prepared two type of image forming elements each having an average particle size of 10 μm were mixed in equal amounts.

Separately, a 6 μm-thick polyethylene terephthalate film was coated with a 5% aqueous solution of polyvinyl alcohol as an adhesive to which a surfactant had been added in a proportion of several drops per 100 cc. Then, the above prepared mixture of image forming elements were dispersed on the support coated with the adhesive and dried in 1 hour in an environment of 80° C. to obtain a sample of the transfer recording medium.

Then, the sample medium was caused to contact a scraping roller rotating at 1000 rpm, which had been prepared by sand-blasting a stainless steel shaft with a diameter of 14 mm, under a contact pressure of 0.2 $kg/cm^2$ and moved at a speed of 300 mm/sec in counter to the rotation of the scraping roller.

The magenta optical density of the sample medium was measured to be 0.6 by an optical densitometer equipped with a green filter. Further, the yellow optical density of the sample medium was measured to be 0.5 by the optical densitometer equipped with a blue filter. The sample was superposed on plain paper with a Bekk smoothness of 10–30 sec., and the resultant laminate was passed through heating and pressing rollers set to 40° C. The sample and the plain paper were peeled from each other by means of a tensile strength tester, whereby the sample transfer medium after the treatment provided a magenta optical density of 0.6 and a yellow optical density of 0.5, thus showing the reaction of $f_1 > f_2$ for both colors of image forming elements.

Then, the sample medium together with the plain paper was passed through the heating and pressing rollers set to 150° C., whereby the sample medium after the peeling showed magenta and yellow optical densities of both below 0.1, thus showing the relation of $f_1 < f_2$ for both colors of image forming elements.

Separately, the sample transfer recording medium before treatment with the scraping roller was illuminated with light rays from a high-pressure mercury lamp at a temperature of 100° C. in the same manner as in Example 1. The sample medium after the illumination was treated with the scraping roller, passed between the heating and pressing rollers set to 150° C. and subjected to peeling in the above described manner. As a result of the repetition of the above operation, the sample medium provided the relation of $f_1 > f_2$ after 60 msec of illumination for the magenta image forming elements and 70 msec for the yellow image forming elements. Separately, the sample medium was illuminated for 350 msec at 30° C. and examined with respect to the relative magnitudes of $f_1$ and $f_2$ in the above described manner, whereby the relation of $f_1 < f_2$ was found to hold with both image forming elements.

Figure 8:
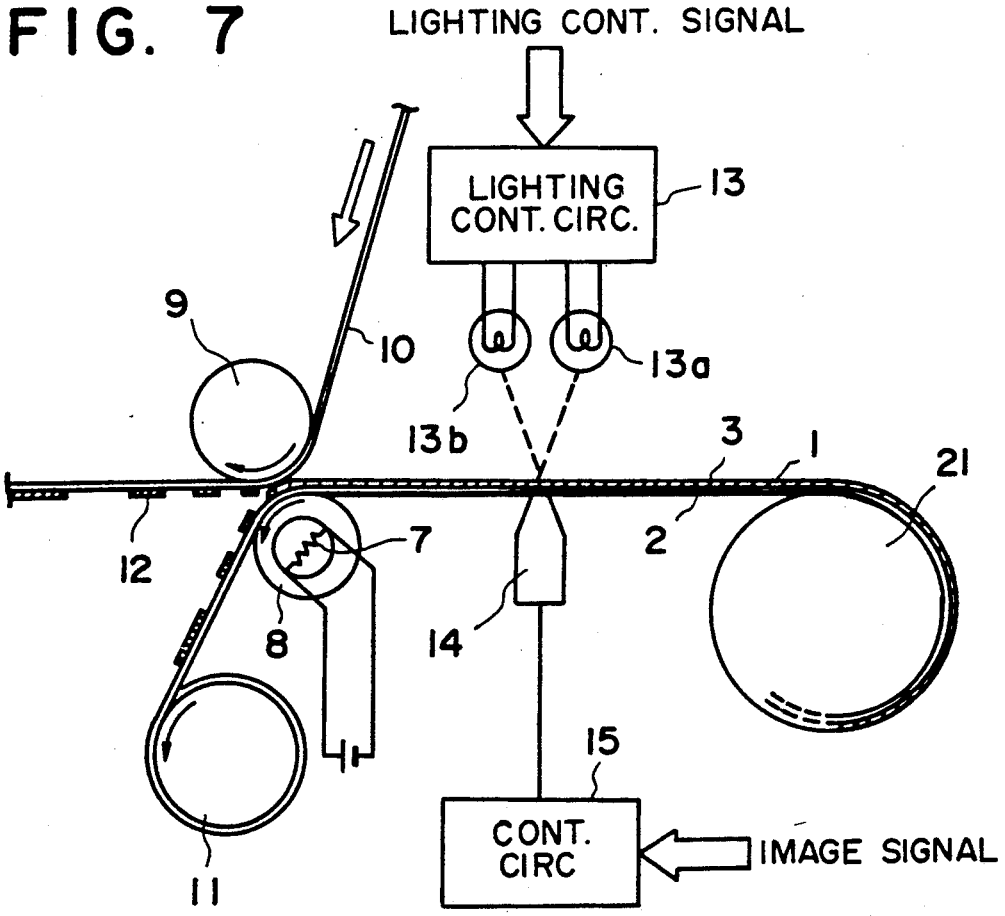
FIG. 8 illustrates a two-color image-recording apparatus using a transfer recording medium of the present invention.

The transfer recording medium thus prepared was wound up in a roll and set in an apparatus as shown in FIG. 12. In the apparatus shown in FIG. 8, the light source included a fluorescent lamp 13*a* having a spectral peak wavelength of 335 nm (FL 10A70E35, mfd. by Toshiba K.K.) and a fluorescent lamp 13*b* having a spectral peak wavelength of 390 nm (FL 10A70E39, mfd. by Toshiba K.K.) corresponding to the spectral absorption characteristics of the two types of image forming elements. The lamps 13*a* and 13*b* were disposed in parallel so as to illuminate the sample surface through a 1 mm-wide slit respectively.

Figure 9:
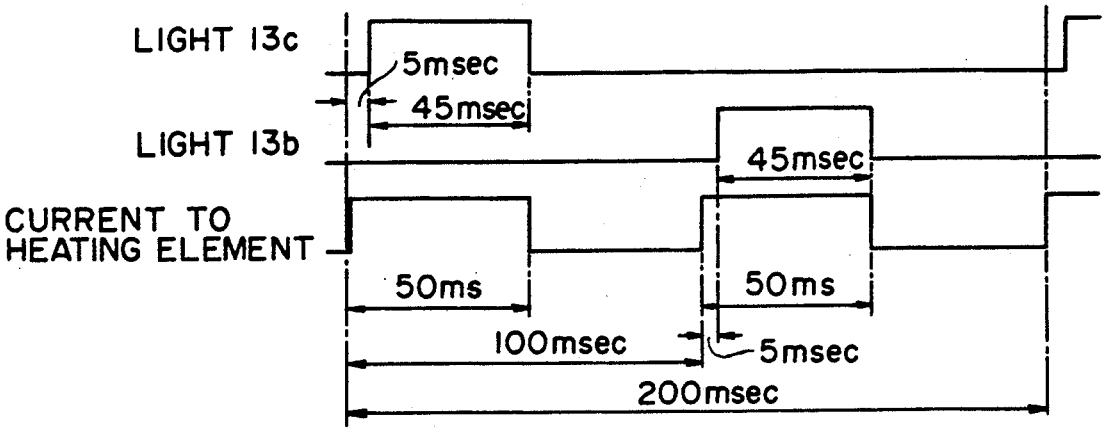
FIG. 9 is a timing chart for signals supplied to a thermal head and a fluorescent lamp for two-color recording in Example 2.

The transfer recording layer had a property of increasing its softening temperature to lose a transferability to the record paper 10 when it was provided with light rays a prescribed wavelength range and heat. For this reason, as shown in the timing chart of FIG. 9, for the purpose of red color recording, a current was supplied for 50 msec not to heating elements corresponding to an image signal of "red" but to heating elements corresponding to an image signal of "white" (the color of the paper 10), and the fluorescent lamp 13*a* was turned on with a time lag of 5 msec to effect uniform illumination. The illumination time, at this time was 45 msec, Next, for yellow color recording, from a point of time 50 msec after the termination of the above illumination, i.e., from the point 100 msec after the commencement of the energization of the heating elements, a current was supplied for 50 msec not to heating elements corresponding to an image signal of "Yellow" but to heating elements corresponding to an image signal of "white", and the fluorescent lamp 13*b* was turned on 5 msec thereafter to effect uniform illumination. The illumination time was equally 45 msec.

In the above described manner, the thermal head 14 was energized under control based on image signals of yellow, red and white to form a negative image in the transfer recording layer, while the transfer recording medium 1 was conveyed in synchronism with the operation in a repetition cycle of 200 msec/line. After the above-mentioned image was formed in this way, a recording paper 10 was superposed onto the image bearing face of the transfer medium, and after heating under pressure, the transfer medium was separated to leave a transferred image of two colors of yellow and red on the recording paper 10. Thus, two-color recording was effected in one sheet.

Figure 10:
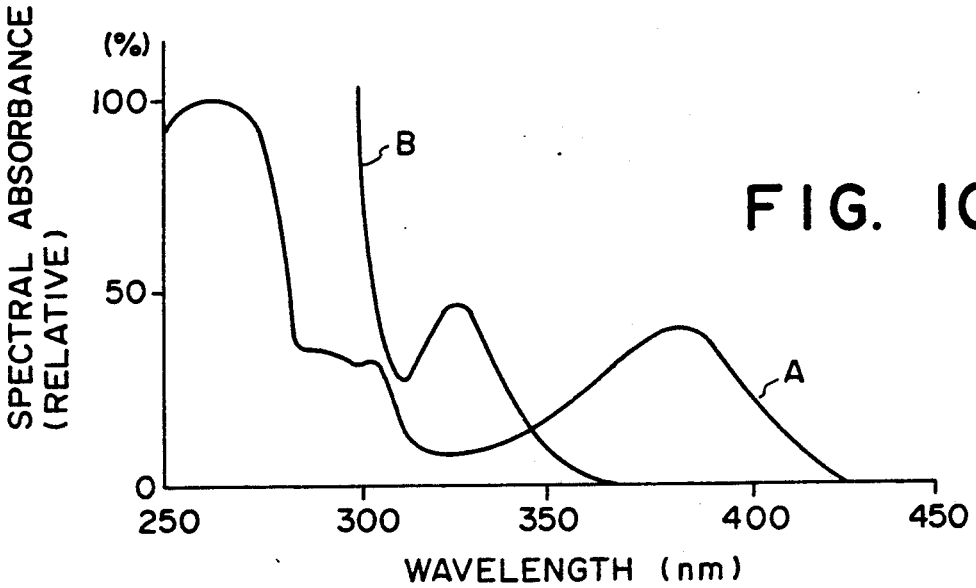
FIG. 10 shows the spectral absorption characteristics of photo-initiators contained in two kinds of image-forming elements in Example 2.
Figure 11:
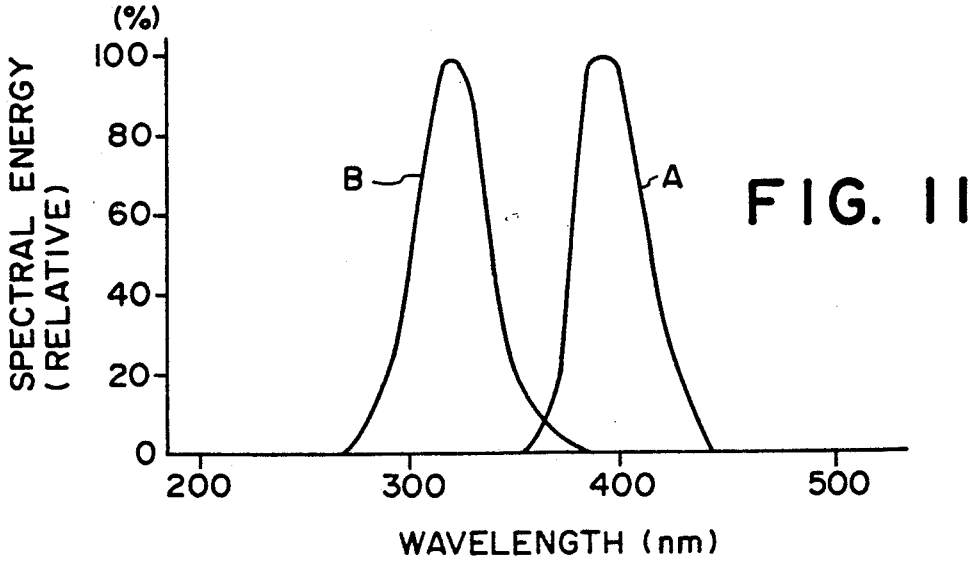
FIG. 11 shows spectral energies of two fluorescent lamps used as light sources corresponding to two kinds of image forming elements in Example 2.

FIG. 10 shows an absorption spectrum A of the photoinitiator given in Table 2 and an absorption spectrum B of the photoinitiator given in Table 3. FIG. 11 shows the spectral energy distributions of the two types of fluorescent lamp used in this Example.

COMPARATIVE EXAMPLE

A composition was prepared by using Aronix M-7100 (mfd. by Toa Gohsei Kagaku Kogyo K.K.) instead of the polymerizing component shown in Table 2 together with the other components in Table 2. The composition was microencapsulated and used to prepare a sample transfer recording medium of a single color of magenta.

The magenta optical density of the sample medium was measured to be 0.6 by the optical densitometer equipped with a green filter. The sample was superposed on plain paper with a Bekk smoothness of 10–30 sec., and the resultant laminate was passed through heating and pressing rollers set to 40° C. The sample and the plain paper were peeled from each other by means of a tensile strength tester, whereby the sample transfer medium after the treatment-provided a magenta optical density of 0.6, thus showing the reaction of $f_1 > f_2$ for the magenta image forming elements.

Then, the sample medium together with the plain paper was passed through the heating and pressing rollers set to 150° C., whereby the sample medium after the peeling showed magenta optical density of below 0.1, thus showing the relation of $f_1 < f_2$.

Separately, the sample transfer recording medium before treatment with the scraping roller was illuminated with prescribed light rays from a high-pressure mercury lamp at a temperature of 100° C. in the same manner as in Example 1. The sample medium after the illumination was treated with the separating roller, passed between the heating and pressing rollers set to 150° C. and subjected to peeling in the above described manner. As a result of the repetition of the above operation, the sample medium reached an optical density of 0.42 providing the relation of $f_1 > f_2$ after 80 msec of illumination. Separately, the sample medium was illuminated for 400 msec at 30° C., passed together with plain paper between heated rollers set to 150° C. and then peeled from the plain paper. The thus treated transfer medium showed a density of 0.32.

Then, the above sample medium was used for image formation in the same manner as in Example 1 whereby the resultant image contained some dropping of image portions.

As described above, in the transfer recording medium according to the present invention, the recording layer loses its transferability with a small light energy when it is supplied with a heat energy simultaneously with the light energy but retains its transferability to a transfer-receiving medium against a large light energy in the absence of simultaneous provision of heat energy. For this reason, the transfer recording medium of the present invention retains a high environmental stability in comparison with a conventional transfer recording medium which utilizes only a heat energy and is affected by an environmental temperature and another conventional transfer recording medium which causes a change in characteristic with only light energy. As a result, the recording medium of the present invention can stably provide high quality and fine images. Further, for the same reason, the recording medium has been improved in storability and provides recorded image with excellent storability.

Further, as compared with a conventional medium using only a single kind of energy such as heat, in which the recording speed is controlled by the heat response characteristic of the system or in which a long period of time is required because an amount of energy required for image formation is provided by a single kind of energy, the recording medium according to the present invention is adapted for high speed recording because a plurality of energies are used to control the transfer characteristic. Further, as a transferable image is formed by a combination of plural kinds of energies, it is easy to control stepwise the stages of change in transfer characteristic for formation of the transferable image so that a medium tone recording can be realized.

Moreover, a transferable image can be formed selectively at image forming elements which have effectively received both light and heat energies even if the provision of both energy is not effected simultaneously and with complete focusing, whereby reduction in apparatus cost is achieved and difficulties with image such as white dropping and fog can be remarkably decreased.

What is claimed is:

1. A transfer recording medium comprising a support and a recording layer formed thereon; said recording layer comprising at least (a) a colorant, (b) a photoinitiator, and (c) a functional component which is, in combination with the photoinitiator, sensitive to light energy and heat energy, said functional component comprising a polymerizing component selected from the group consisting of polymerizable monomers, oligomers and prepolymers, which are solid at room temperature; said recording layer having a glass transition temperature in the range of 30° C. to 150° C.; wherein the adhesion force ($f_1$) between the support and the recording layer and the adhesion force ($f_2$) between the recording layer and a transfer receiving medium after they are subjected to heat and pressure while being in contact with each other satisfy the relationship that ($f_1$) is greater than ($f_2$) at a lower temperature and ($f_2$) is greater than ($f_1$) at a higher temperature; wherein an irreversible change in the adhesion forces occur when the recording layer is exposed to a light beam with the wavelength region to which the functional component is sensitive at 100° C., such that ($f_1$) becomes greater than ($f_2$) at the higher temperature and with the proviso that if the minimum quantity of light required to irreversibly change the adhesion force relationship so that ($f_1$) is greater than ($f_2$) at the higher temperature is nJ/cm$^2$, then ($f_2$) remains greater than ($f_1$) when the recording layer is exposed to light in a quantity of 5 times nJ/cm$^2$ at 30° C.

2. A transfer medium according to claim 1, wherein ($f_2$) remains greater than ($f_1$) when the recording layer is exposed to light in a quantity of 10 times nJ/cm$^2$ at 30° C.

3. A transfer recording medium according to claim 1, wherein said lower temperature is 40° C. and said higher temperature is 150° C.

4. A transfer recording medium according to claim 1, wherein said recording layer comprises a distributed layer of image forming elements.

5. A transfer recording medium according to claim 4, wherein said image forming elements are in the form of microcapsules.

6. A transfer recording medium according to claim 4, wherein said recording layer comprises plural kinds of image forming elements containing different photoinitiators having mutually different sensitive wavelength regions.

* * * * *

UNITED STATES PATENT AND TRADEMARK OFFICE

CERTIFICATE OF CORRECTION

PATENT NO. : 5,034,301

DATED : July 23, 1991

INVENTOR(S) : Masashi Miyagawa et al

It is certified that error appears in the above-indentified patent and that said Letters Patent is hereby corrected as shown below: On the title page: Item

[56] REFERENCES CITED

FOREIGN PATENT DOCUMENTS, "261394 of 1876" should read --261394 3/1988--.

Under FOREIGN PATENT DOCUMENTS, insert:

| | | | |
|---|---|---|---|
| -- | 974837 | 11/1964 | United Kingdom |
| | 1077977 | 3/1960 | Fed. Rep. of Germany |
| | WO 85-00670 | 2/1985 | PCT |
| | 205083 | 12/1986 | European Pat. Off. |

OTHER PUBLICATIONS

Patent Abstracts of Japan, vol. 11, no. 303 (P-622) (2750), 10/03/87.

R.V. Kollarits et al., "Color Electronic Imaging with Mead Microencapsulated Paper," 1985, pp. 147-149, Int'l. Disp. Res. Conf., I.E.E.E.-

COLUMN 1

Line 18, "light weight," should read --lightweight,--.
Line 20, "Accordingly" should read --Accordingly,--.
Line 34, "used prob-" should read --used, prob- --.
Line 47, "increase," should read --increase--.

COLUMN 2

Line 2, "colors it" should read --colors, it--.
Line 14, "thermal," should read --thermal--.

UNITED STATES PATENT AND TRADEMARK OFFICE

CERTIFICATE OF CORRECTION

PATENT NO. : 5,034,301

DATED : July 23, 1991

INVENTOR(S) : MASAHI MIYAGAWA, ET AL

It is certified that error appears in the above-indentified patent and that said Letters Patent is hereby corrected as shown below:

COLUMN 2

Line 15, "method," should read --methods,--.
Line 54, "single," should read --single--.
Line 56, "colorform-" should read --color-form- --.
Line 60, "pressure of application," should read --application of pressure,--.
Line 61, "the enclosed" should read --be enclosed--.
Line 67, "above mentioned" should read --above-mentioned--.

COLUMN 3

Line 17, "fer,-receiving" should read --fer-receiving--.
Line 19, "imageforming" should read --image-forming--.
Line 34, "multi color" should read --multi-color--.
Line 38, "used" should read --use--.

COLUMN 5

Line 51, "initiator," should read --initiator--.

COLUMN 6

Line 54, "layer The" should read --layer. The--.

COLUMN 7

Line 6, "charge" should read --change--.

UNITED STATES PATENT AND TRADEMARK OFFICE

CERTIFICATE OF CORRECTION

PATENT NO. : 5,034,301

DATED : July 23, 1991

INVENTOR(S) : MASAHI MIYAGAWA, ET AL

It is certified that error appears in the above-indentified patent and that said Letters Patent is hereby corrected as shown below:

COLUMN 9

Line 1, "are" should read --is--.
Line 3, Close up right margin.
Line 4, Close up left margin.
Line 15, "are contacted" should read --are contacted with--.
Line 27, "rollertempera-" should read --roller tempera- --.

COLUMN 10

Line 47, "$f_1>f_2$) On" should read --$f_1>f_2$). On--.

COLUMN 11

Line 12, "($f_1>f_2$)" should read --($f_1>f_2$).--.
Line 48, Close up right margin.
Line 49, Close up left margin.
Line 50, "port" should read --part--.
Line 64, "$f_2$ The" should read --$f_2$. The--.

COLUMN 13

Line 15, "record" should read --recorded--.

COLUMN 14

Line 43, "movolak" should read --novolak--.
Line 61, "resin. The" should read --resin. ¶ The--.

UNITED STATES PATENT AND TRADEMARK OFFICE

CERTIFICATE OF CORRECTION

PATENT NO. : 5,034,301

DATED : July 23, 1991

INVENTOR(S) : MASASHI MIYAGAWA, ET AL

It is certified that error appears in the above-indentified patent and that said Letters Patent is hereby corrected as shown below:

COLUMN 15

Line 51, "monomer" should read --monomer,--.

COLUMN 16

Line 19, "urethane-acrylictype," should read --urethane-acrylic-type,--.

COLUMN 17

Line 26, "α" should read -- α --.
Line 27, "β" should read -- β --.
Line 33, "1 - α" should read -- a - α --.
Line 34, "a - β ," should read -- a - β ,--;
"b - β ," should read -- b - β ,--;
"b - α ," should read -- b - α ,--.
Line 35, "light source - α" should read --light source - α --.
Line 36, "light source - β" should read --light source - β --.

COLUMN 18

Line 66, "an" should read --a--.

COLUMN 20

Line 24, "thermal head 4" should read --thermal head 14--.

UNITED STATES PATENT AND TRADEMARK OFFICE

CERTIFICATE OF CORRECTION

PATENT NO. : 5,034,301

DATED : July 23, 1991

INVENTOR(S) : MASASHI MIYAGAWA, ET AL

It is certified that error appears in the above-indentified patent and that said Letters Patent is hereby corrected as shown below:

COLUMN 21

Line 33, "type" should read --types--.

COLUMN 23

Line 22, "treatment-provided" should read --treatment provided--.

COLUMN 24

Line 17, "energy" should read --energies--.

COLUMN 24

Line 40, "occur" should read --occurs--.

Signed and Sealed this

Twenty-eighth Day of December, 1993

*Attest:*

Bruce Lehman

BRUCE LEHMAN

*Attesting Officer*

*Commissioner of Patents and Trademarks*